United States Patent [19]

Sundberg

[11] 4,413,686

[45] Nov. 8, 1983

[54] WEDGE ARRANGEMENT FOR LOCKING TOGETHER HAMMERHEAD AND ANVIL

[75] Inventor: Erik Sundberg, Hofors, Sweden

[73] Assignee: Waller Innovation AB, Hofors, Sweden

[21] Appl. No.: 483,413

[22] Filed: Apr. 8, 1983

Related U.S. Application Data

[63] Continuation of Ser. No. 198,998, Oct. 21, 1980, abandoned.

[30] Foreign Application Priority Data

Feb. 5, 1980 [SE] Sweden ..... 8000908

[51] Int. Cl.[3] ..... B25D 17/08

[52] U.S. Cl. ..... 173/131; 173/126; 403/19; 72/478; 279/86; 241/197; 299/94

[58] Field of Search ..... 72/478; 83/698; 173/126, 127, 128, 131, 132; 279/85, 86; 403/19, 20, 379, 409; 241/197, 273, 291; 299/94

[56] References Cited

U.S. PATENT DOCUMENTS

| | | | |
|---|---|---|---|
| 795,331 | 7/1905 | Brinton | 241/294 |
| 1,302,274 | 4/1919 | Arthur | 72/478 X |
| 1,322,525 | 11/1919 | Blowers | 83/698 X |
| 1,598,426 | 8/1926 | Ditson | 173/132 X |
| 2,725,210 | 11/1955 | Swartz | 403/379 X |
| 2,846,248 | 8/1958 | Kliwer | 403/379 |
| 2,851,239 | 9/1958 | Truax | 403/409 X |
| 3,301,581 | 1/1967 | Winberg | 403/379 |
| 3,679,144 | 7/1972 | Bogle | 241/291 X |
| 3,722,932 | 3/1973 | Dougall | 403/379 |
| 4,253,706 | 3/1981 | Hay | 173/126 X |

FOREIGN PATENT DOCUMENTS

| | | | |
|---|---|---|---|
| 456929 | 4/1950 | Italy | 403/379 |

*Primary Examiner*—Frederick R. Schmidt
*Assistant Examiner*—Robert P. Olszewski
*Attorney, Agent, or Firm*—Sughrue, Mion, Zinn, Macpeak and Seas

[57] ABSTRACT

When inserting a locking wedge (14) having planar wedge surfaces (16, 17) between an anvil (4; 5) and a hammerhead (1) or an anvil block lining (6) the wedge (14), which is provided with a draw head (18; 22) is drawn in between two mutually converging locking surfaces (9, 7) on the anvil and the hammerhead or the anvil block insert.

4 Claims, 6 Drawing Figures

WEDGE ARRANGEMENT FOR LOCKING TOGETHER HAMMERHEAD AND ANVIL

Figure 1:
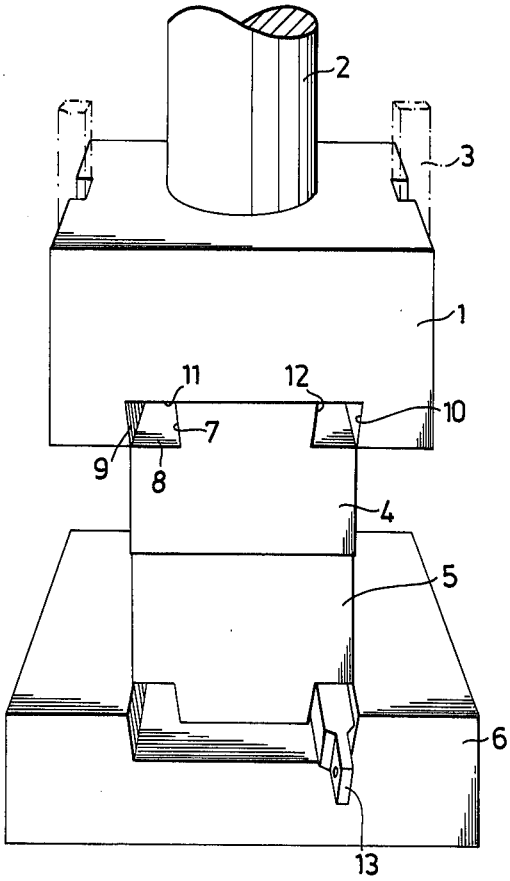

This application is a continuation of application Ser. No. 198,998, filed Oct. 21, 1980, now abandoned.

The invention relates to a method of inserting a locking wedge having planar locking surfaces between an anvil and a hammerhead or an anvil block insert of a hammer, said wedge being inserted between a locking surface on the anvil and a locking surface on the hammerhead or the anvil block insert, said two locking surfaces being planar and being inclined to a vertical plane and converging towards each other.

Hitherto wedges have been forced into the groove formed between the locking surfaces by means of sledges, pendulum hammers, pneumatic drifters or hydraulic impact tools. All of these methods, however, are unsuitable, both from an environmental aspect, with view to the high noise level created, the vibrations and direct injuries to which the operators are subjected, and from the fact that damage is caused to the wedges, to the locking surfaces which form the grooves, and to the guides of the machine.

Probably the most serious problem is that, in order to obtain positive locking when the wedge is driven in, the force required is so great that the normal pressure exceeds the yield point of the material. This is due to the fact that the wedge, when struck by a driving tool, or subjected to a pressure force, becomes slightly compressed, i.e. its locking surfaces move away from each other and therewith meet excessive resistance against the co-acting locking surfaces of the groove. As soon as the impact stroke or pressure force ceases, the wedge returns to its original form, i.e. its locking surfaces approach each other, therewith impairing the engagement and locking effect of said wedge.

Methods used hitherto for driving the wedges into said grooves result in progressive deformation of the locking surfaces of the wedge, the anvil, the hammerhead and the anvil block insert, and cause the guides of the machine to wear much too quickly. A natural consequence hereof is that, after being used for some time, the hammerhead and anvil block insert cannot be safely used for their intended purpose; that the worn machine guides impair the precision of the forging processes and the forged products; and that expensive repairs must be carried out much too often.

A prime object of the invention is to provide a novel method by which risk of damage to the locking surfaces is completely eliminated; and which affords much safer locking than is possible with the conventional locking methods. A further object is to avoid noise and personnel injury when changing the anvil, and to eliminate impact stresses and pressure stresses on the hammerhead guide in conventional locking methods.

The method according to the invention is characterized in that, when locking the anvil to the hammerhead or anvil block insert, each locking wedge is drawn into a respective groove or wedgeway.

By exerting a drawing force on the narrow end of the wedge, and drawing the wedge into the groove, the wedge is stretched so that its locking surfaces move towards each other, and when the wedge has reached the desired locking position and the pulling or drawing force removed, the wedge will complete or partly return to its original form, i.e. its locking surfaces will be urged still more strongly against the co-acting locking surfaces of the groove.

The novel wedge arrangement for carrying out the method includes a wedge body having two planar locking surfaces and a wedge angle which is adapted to enable the wedge to be drawn in between the locking surfaces of a groove, and is substantially characterized in that the wedge body is provided at the ends thereof with a respective draw head arranged to be connected to a drawing or pulling means when drawing said wedge into and out of said groove.

By means of the present invention, the working environment is improved, since noise and vibrations are avoided, while the risk of injury to the operator, e.g. from shivers of metal from the impact devices, is eliminated.

Further, such damage to the machine as that caused when changing an anvil in accordance with previously known methods is avoided, since in accordance with the invention there is preferably used wedge linings or inserts which protect the locking surfaces on the hammerhead and anvil block lining, and since less force is required when drawing a wedge into a respective groove than when driving in said wedge. When drawing a wedge into a groove in accordance with the invention, the hammerhead or anvil block insert is used as a dolly or reaction surface, instead of causing the guides to take-up the whole of the driving force, as is the case when driving a wedge into said groove, the latter resulting in heavy wear on the guides with a subsequently impaired guiding effect.

Figure 2:
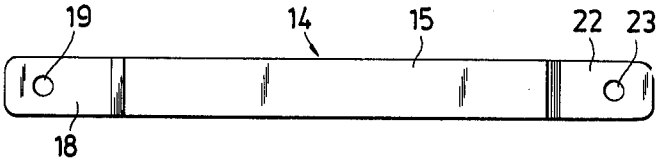
Figure 3:
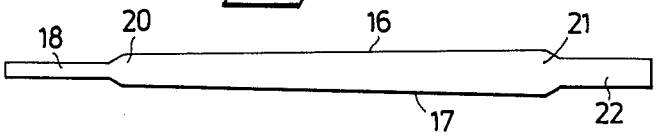
Figure 4:
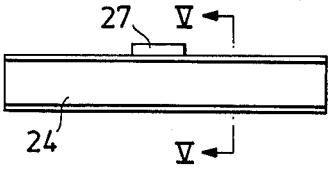
Figure 5:
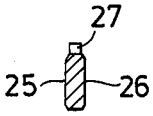
Figure 6:
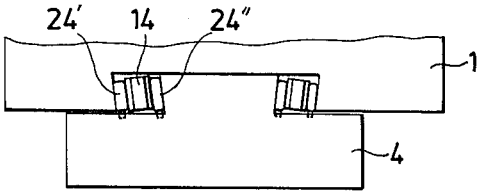

The invention will now be described in more detail with reference to the accompanying drawings, in which FIG. 1 illustrates in a simplified manner the most essential elements of a hammer with respect to the present invention, FIG. 2 is a sideview of a wedge according to the invention, FIG. 3 is a planview of the wedge shown in FIG. 2, FIG. 4 is a sideview of a wedge lining or insert, FIG. 5 is a sectional view taken on the line V—V in FIG. 4, and FIG. 6 is a simplified view of a hammerhead firmly locked to an upper anvil by means of a wedge arrangement according to the invention.

FIG. 1 illustrates in a simplified manner a hammer having a hammerhead 1 which is driven by means of a rod 2, said rod being mounted in a frame structure, not shown. The hammerhead 1 is guided for vertical movement by guides 3 shown in broken lines. The hammerhead 1 has a planar, horizontal surface 11 to which there is attached an upper anvil 4. The upper anvil 4 is arranged to co-act with a lower anvil 5 which is mounted on an anvil block insert 6. The anvil block insert 6 is mounted in said frame structure (not shown). Extending along the upper, left-hand edge of the upper anvil 4 is a bevelled groove which is defined on one side by a locking surface 7, which is planar and extends along the whole length of the anvil 4, and, in the illustrated embodiment, on another side by a planar surface 8, which forms a guide surface for a wedge but which has no locking function. The locking surface 7 is inclined somewhat to the vertical plane. The hammerhead is provided with a wide groove which in cross-section has a dovetail configuration and which is defined by side surfaces 9 and 10 and bottom surface 11. All the surfaces are planar. The surface 11 coincides with the horizontal plane and the surfaces 9 and 10 are inclined towards the horizontal plane, and, in the illustrated embodiment, have the same angle of inclination as the locking surface 7. The upper planar surface of the anvil 4 abuts the surface 11, and the impact forces exerted by the hammerhead 1 are transferred to the anvil 4 via these surfaces. Arranged along the upper, righthand edge of the anvil 4 is a locking surface 12 of the same form as the locking surface 7. The locking surfaces 9 and 7 converge towards each other from the leading surface of the hammerhead 1 and the anvil 4, as seen in FIG. 1, and form a wedge-receiving groove. A corresponding, tapering groove is formed by the locking surfaces 10 and 12, although in this case the groove tapers in the opposite direction. The lower anvil 5 and the anvil block insert 6 are provided with corresponding locking surfaces, and in FIG. 1 a wedge 13 is shown inserted in the right-hand groove between the lower anvil 5 and the anvil block insert or lining 6.

A wedge 14 according to the invention is illustrated in FIGS. 2 and 3. The wedge 14 includes a wedge body 15, shown in side view, and has a constant height or thickness, the thickness of said wedge being slightly less than the depth of a locking surface, e.g. the locking surface 9. The wedge body 15 has two mutually converging planar locking surfaces 16 and 17, and the wedge angle is adapted to enable the wedge to be drawn in between the locking surfaces of the groove, e.g. between the surfaces 7, 9. Arranged on the narrow end 20 of the wedge body 15 is a draw head 18, which in the illustrated embodiment is provided with a hole 19 through which said head can be coupled to a drawing device. The wider end 21 of the wedge body 15 is provided with a similar draw head 22 having a through-passing hole 23 by which said head 22 can be coupled to a drawing device, when wishing to draw the wedge out from in between said locking surfaces.

When a wedge according to FIGS. 2 and 3 is used, the head 18 is inserted into the insert-opening of a groove, for example the opening between the locking surfaces 7 and 9 visible in FIG. 1, with the wedge surfaces 16 and 17 facing respective surfaces 7, 9. The wedge is inserted manually and a draw rod is coupled to the head 18, which preferably extends out of the rear opening of said groove. A similar wedge 14 is inserted in the groove formed between locking surfaces 10 and 12, although in this case in the reverse direction. The wedges are then drawn into respective grooves, to a desired locking position. When a wedge according to the invention is to be removed, e.g. in order to replace an anvil, the head 22 of the wedge is coupled to said drawing device and the wedge loosened, with less risk of damage to the wedge or to the locking surfaces.

In order to optimally utilize the advantages afforded by the wedge to provide an improved sliding effect; more positive locking; and to completely eliminate the risk of deformation of the locking surfaces on the anvil, hammerhead and anvil block insert, wedge linings or inserts are placed between respective wedges and locking surfaces, e.g. locking surfaces 7 and 9. One such lining 24, which may comprise a rectangular bar of uniform thickness, is illustrated in FIGS. 4 and 5 while FIG. 6 illustrates a wedge lining in position. The wedge lining 24 has mutually parallel surfaces 25 and 26, said surfaces preferably being nitrogen case hardened, for optimal sliding between insert and wedge surface.

Preferably, that surface of each insert which is to abut a wedge surface is smoothed, as is also said wedge surface. In contradistinction to the case with conventional wedge arrangements, there is no risk of the two surfaces jamming together when the wedge is drawn into the groove. To prevent respective linings 24, which have a height or thickness corresponding to or slightly less than the height or thickness of the wedge 14, from sliding relative to the locking surface, e.g. the surface 7, there is provided a shoulder 27 which is received in a corresponding recess in, for example, the surface 8 of the anvil.

FIG. 6 illustrates in a simplified manner the positioning of lining 24' and 24" on opposite sides of the wedge 14. The described web and linings may be modified in various ways. For example, the draw heads may have the form of draw rods provided with a screw-threaded part arranged to be screwed into the piston of a jack. The draw heads may also be formed directly on the end portions of said wedge and thus need not be formed as parts of substantially uniform thickness, as illustrated in FIG. 2. The wedge lining 24 may have the form of angled plates which completely or partially surround all four surfaces of an associate wedge, which wedge is preferably manufactured from toughered steel.

I claim:

1. A hammerhead (1) and anvil (4) locking arrangement, comprising:

(a) a resiliently deformable locking wedge (14) having converging, opposite, planar side surfaces (16, 17), (b) means defining a first planar locking surface (7) on an anvil, (c) means defining a second planar locking surface (9) on a hammerhead, (d) said first and second locking surfaces converging at an angle equal to an angle of convergence of said wedge, defining between them a wedge receiving groove, and being inclined to a vertical plane, and (e) an insertion draw head (18) defined on a leading, relatively narrow end (20) of said wedge for tensioning said wedge to draw it firmly into the groove in mating engagement with the locking surfaces and to simultaneously longitudinally extend and laterally contract the wedge, and for releasing said tension to longitudinally contract and laterally expand the wedge to firmly lock it in said groove.

2. A locking arrangement according to claim 1, wherein the wedge is provided at a relatively wide, trailing end (21) with an extraction draw head (22).

3. A locking arrangement according to claim 1, wherein the locking surfaces are provided with removable inserts (24) of uniform thickness, arranged to co-act with the side surfaces of said wedge.

4. A locking arrangement according to claim 2, wherein the locking surfaces are provided with removable inserts (24) of uniform thickness, arranged to co-act with the side surfaces of said wedge.

* * * * *